United States Patent [19]

Edwards

[11] 3,977,223

[45] Aug. 31, 1976

[54] HOT STRIP MILL TENSION CONTROL

[75] Inventor: William John Edwards, Newcastle, Australia

[73] Assignee: John Lysaght (Australia) Limited, Sydney, Australia

[22] Filed: Apr. 1, 1975

[21] Appl. No.: 563,984

[30] Foreign Application Priority Data

Apr. 2, 1974 Australia ..... 7117/74

[52] U.S. Cl. ..... 72/17

[51] Int. Cl.[2] ..... B21B 37/06

[58] Field of Search ..... 72/6, 8, 9, 10, 11, 72/12, 17

[56] References Cited

UNITED STATES PATENTS

| | | | |
|---|---|---|---|
| 3,049,036 | 8/1962 | Wallace et al. | 72/9 |
| 3,334,502 | 8/1967 | Heindel et al. | 72/9 |
| 3,507,134 | 4/1970 | Silva | 72/8 |
| 3,744,287 | 7/1973 | Silva | 72/8 |
| 3,848,443 | 11/1974 | Peterson et al. | 72/8 |

*Primary Examiner*—Milton S. Mehr

*Attorney, Agent, or Firm*—Beveridge, DeGrandi, Kline & Lunsford

[57] ABSTRACT

A method and apparatus for adjusting the roll separation and roll speed of the roll stands of a tandem rolling mill so as to control the position of interstand looper arms without creating undesirable thickness changes. Each looper position is controlled by simultaneous adjustment of the roll separation and roll speed of the downstream stand, and adjustment of the roll separation of the upstream stand.

7 Claims, 1 Drawing Figure

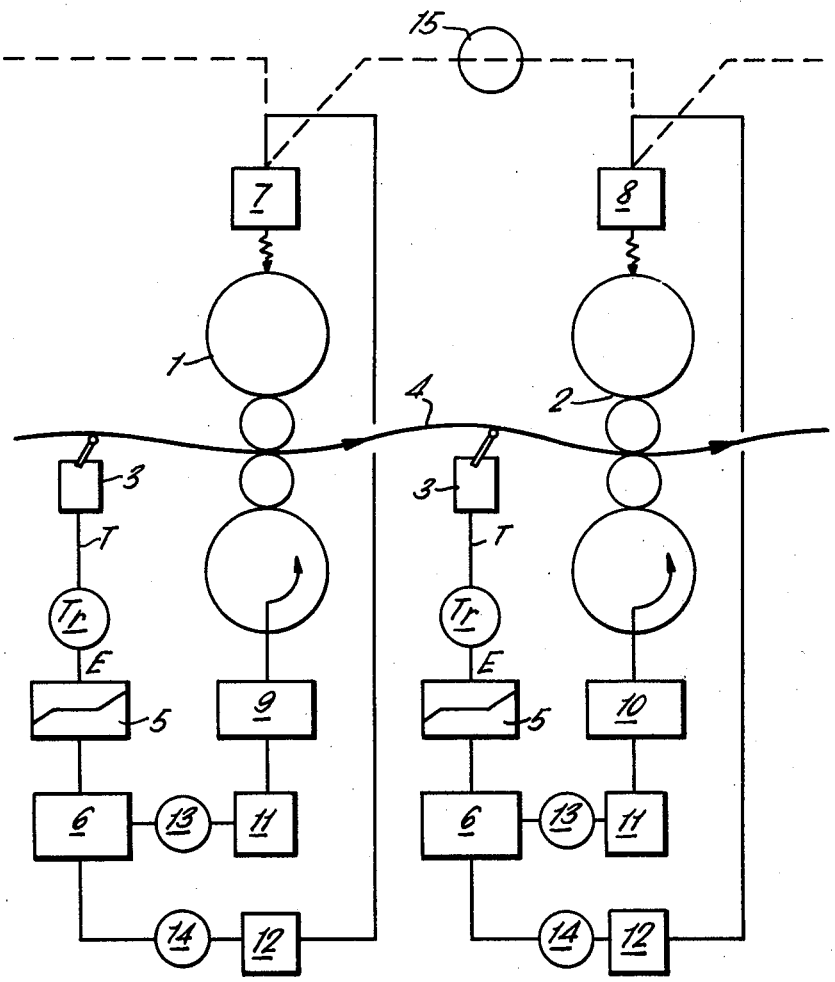
15
7
8
1
2
4
3
3
T
T
Tr
Tr
E
E
5
5
9
10
6
6
13
13
11
11
14
14
12
12

HOT STRIP MILL TENSION CONTROL

This invention relates to control of strip tension between adjacent stands of a strip rolling mill, and, in particular, a tandem hot strip mill.

It is conventional practice to provide an interstand tension sensing device or looper, which adjusts the speed regulators of one or both stands so as to maintain the looper arm position at a pre-determined value or within a desired range. By "tension sensing device" or looper, we mean a pivoted arm which bears against the strip, between consecutive stands. The shaft around which this device pivots has a controlled torque applied to it, usually by an electric or electromagnetic armature or by hydraulic or pneumatic means. Any change in the interstand strip length would cause this arm to rotate. The angular displacement at the pivot point will be a function of the vertical displacement of the strip from the horizontal plane. This angular displacement provides a signal to the tension control system. Hence the device does not, in fact, detect the tension in the strip, merely strip position, at the looper roller, and it is this position which must be controlled.

A change in the position of the looper arm indicates that strip velocity as it leaves the previous, or upstream, stand, does not equal the strip velocity entering the next, or downstream stand, indicating that a strip speed adjustment is required if the looper arm position is to be restored or reset. In conventional tension control systems this is achieved by adjusting either the drive motor speed of the previous, or upstream stand, or the drive motor speed of the next or downstream stand. To avoid disturbing the other interstand looper arm positions it is common practice to also adjust the other upstream motor speeds, or the other downstream motor speeds, as the case may be, in the same percentage as that applied to the stand near the looper which initiated the variation.

Certain practical advantages accrue if one stand near the middle of the mill train is not used for looper position control. The looper arms upstream of this stand are then controlled using upstream motor speed adjustments in the manner previously described, and similarly the downstream looper arms are controlled using downstream motor speed adjustments.

Various types of disturbances can occur in a rolling mill and can cause off-specification product to be produced. Frequently, the above mentioned form of conventional tension control can aggravate this situation. For example, when the feed strip or a portion thereof enters the mill at a temperature below the anticipated temperature, or is of a greater hardness than the standard feed, it will be compressed less than the desired amount, and a thickness error will develop. This error will reduce the elongation of the strip as it progresses from stand to stand, and the looper arm will be depressed with respect to its desired value. Conventional control systems would reduce the drive speed of a downstream stand or stands (or else increase the speed of an upstream stand or stands) in reponse to this detected deviation to correct the looper arm position. This action would tend to vary the thickness reduction at each stand away from the desired value. It would not provide an inherent thickness controlling facility.

To overcome these and other problems, the invention provides a method of controlling strip tension or looper position between a first stand and an adjacent downstream second stand of a strip rolling mill, at which stands the thickness of said strip is progressively reduced, comprising sensing said looper position, comparing said position with a predetermined value or range, and simultaneously adjusting the roll separation and driving speed in said second stand in response to deviation of said position from said predetermined value or range; the magnitudes of said adjustments of roll separation and drive speed being related by a predetermined function of the dimensions of said strip at each of said stands, hardness of said strip, stiffness of said stands motor characteristics and the drive speeds of said stands. The roll speed adjustments are necessary to compensate for torque changes which will accompany the change in roll separation.

The invention also provides a method according to the preceding paragraph further comprising adjusting the roll separation in said first stand simultaneously with and in proportion to the roll separation adjustments in said second stand. The proportion would normally be less than unity and would be determined by the relationship between strip tension and looper arm position.

The conventional gaugemeter systems are no longer required when this improved form of tension control is installed. A conventional gauge control system based on an X-Ray gauge located after the last stand is then sufficient to eliminate the small thickness errors which may occur. This system would adjust the speeds of preferably, the last two or three stands to maintain the exit gauge at its desired value. It is implicit that the initial setting of the mill actuators, that is, roll speeds and screw positions, is performed accurately, preferably using a suitably programmed digital computer.

To facilitate a full understanding of the invention, a presently proposed embodiment is described hereinafter with reference to the accompanying flow diagram.

Items 1 and 2 are any two consecutive stands in a tandem hot strip mill with roll separation adjustment actuators 7 and 8 and motor speed regulators 9 and 10. A metal strip travels between stands 1 and 2 and the strip position is sensed by loopers 3 whose output signal is compared with a reference value Tr to obtain an error signal E.

Error signal E is processed in a control system component 5 commonly called a "dead zone" and a conventional Controller 6. In a dead zone controller, if the error signal is within preselected allowable error limits, then no output signal is transmitted. Where the error signal is above or below these allowable limits, then an output signal proportional to the deviation from allowable limits is transmitted. The output signal from the conventional controller 6 is then proportioned, according to coefficients 14 and 13, and the resulting signals are transmitted respectively to the roll separation actuator 8 and the roll speed actuator 10.

The coefficients 13 and 14 serve to relate the motor speed adjustment to the roll separation adjustment. These coefficients are functions of the product dimensions at each stand, the hardness of the material being rolled, the mill stand stiffness, motor characteristics and the rolling mill speed in the stands 1 and 2. The relationship between these coefficients may be derived from conventional rolling theory.

Preferably the coefficient 14 should be adjusted in proportion to the function:

$$\frac{h(1-\frac{\delta F}{\delta h}/M)}{V}$$

calculated for the downstream stand 2, where $h$ is exit thickness, $F$ is total roll force, $M$ is the mill modulus, and $V$ the input strip velocity. Similarly, the coefficient 13 should be adjusted in proportion to the function.

$$dh \cdot \frac{\delta G}{\delta H}$$

where $G$ is the total rolling torque, and $d$ is the sensitivity of roll speed to torque changes.

To accommodate the particular dynamic response characteristics of the roll separation actuators 7 and 8 and roll speed actuator 10, filters 12 and 11 may be inserted in the signal paths to those actuators so that these items might operate in unison and that their dynamic responses might be matched.

If desired, a proportion of the signal from the filter 12 of the stand 2 as determined by coefficient 15 may be added to the signal obtained from the adjacent upstream controller. The combined signal is then transmitted to roll separation actuator 7 of stand 1. Similarly, a proportion of the signal from the controller downstream of stand 2 may be combined with the roll separation actuator signal in stand 2 and the combined signal be fed to actuator 8. This alternative feature is illustrated in FIG. 1 by a dotted line.

To assist in maintaining the optimum thickness reduction at each stand, the motor speed ratios should be controlled and maintained at predetermined desired values. This can be done by a separate control system of conventional construction.

The method of the invention provides control of looper position between any two stands by varying the roll separation of the downstream stand so as to maintain a constant strip thickness reduction at the downstream stand. Preferably, each stand is fitted with a fast response actuator for adjusting the roll separation so that deviations in the looper position and strip thickness are minimised.

I claim:

1. A method of controlling strip tension or looper position between a first stand and an adjacent downstream second stand of a hot strip rolling mill, at which stands the thickness of said strip is progressively reduced, comprising sensing said looper position, comparing said position with a predetermined value or range, and simultaneously adjusting the roll separation and driving speed in said second stand in response to deviation of said position from said predetermined value or range; the magnitudes of said adjustments of roll separation and drive speed being related by a predetermined function of the dimensions of said strip at each of said stands, hardness of said strip, stiffness of said stands, motor characteristics and the drive speeds of said stands.

2. A method as claimed in claim 1 further comprising the generation of a signal proportional to said deviation, applying said signal to the input of a conventional controller so as to generate first and second output signals from said contoller proportioning said first and second output signals according to first and second coefficients respectively and applying the resulting first and second proportioned signals respectively to a roll speed actuator and a roll separation actuator associated with said second stand.

3. A method as claimed in claim 2 wherein said first coefficient is proportional to the function;

$$dh. \frac{\delta G}{\delta h}$$

and said second coefficient is proportional to the function:

$$\frac{h(1-\frac{\delta F}{\delta h}/M)}{V}$$

calculated for said second stand and where:

$h$ is exit thickness
$F$ is total roll force
$M$ is the mill modulus
$V$ is the input strip velocity
$G$ is the total rolling torque
$d$ is the sensitivity of roll speed to torque changes.

4. A method as claimed in claim 1 further comprising adjusting the roll separation in said first stand simultaneously with and in proportion to the roll separation adjustments in said second stand.

5. Apparatus for controlling strip tension or looper position between a first stand and an adjacent downstream second stand of a hot strip rolling mill, at which stands the thickness of said strip is progressively reduced, comprising means for sensing said looper position, means for comparing said position with a predetermined value or range and means for generating a signal proportional to the deviation of said position from said predetermined value or range, means for applying said signal to the input of a conventional controller, means in said controller for simultaneously generating first and second output signals, means for proportioning said first output signal in accordance with a first coefficient, means for proportioning said second output signal in accordance with a second coefficient, and means for applying the resulting first and second proportioned signals respectively to a roll speed actuator and a roll separation actuator associated with said second stand.

6. Apparatus as claimed in claim 5 wherein said first coefficient is proportional to the function:

$$dh. \frac{\delta G}{\delta h}$$

and said second coefficient is proportional to the function:

$$\frac{h(1-\frac{\delta F}{\delta h}/M)}{V}$$

calculated for said second stand and where:

$h$ is exit thickness
$F$ is total roll force
$M$ is the mill modulus
$V$ is the input strip velocity
$G$ is the total rolling torque
$d$ is the sensitivity of roll speed to torque changes.

7. Apparatus as claimed in claim 5 further comprising means for adjusting the roll separation in said first stand simultaneously with and in proportion to the roll separation adjustments in said second stand.

* * * * *